US006178885B1

(12) United States Patent
Yasoshima

(10) Patent No.: US 6,178,885 B1
(45) Date of Patent: Jan. 30, 2001

(54) INK VESSEL-CONTAINING STAMP PAD

(75) Inventor: Rira Yasoshima, Tokyo (JP)

(73) Assignee: Tsukineko, Inc., Redmond, WA (US)

( * ) Notice: Under 35 U.S.C. 154(b), the term of this patent shall be extended for 0 days.

(21) Appl. No.: 09/347,685

(22) Filed: Jul. 2, 1999

(30) Foreign Application Priority Data

Oct. 30, 1998 (JP) ..... 10-310502

(51) Int. Cl.[7] ..... B41K 1/54
(52) U.S. Cl. ..... 101/333; 401/119; 401/123
(58) Field of Search ..... 101/333; 118/265; 401/19, 123, 124, 125, 126

(56) References Cited

U.S. PATENT DOCUMENTS

| | | | | |
|---|---|---|---|---|
| 200,389 | | 2/1878 | Grinnan . | |
| D. 364,183 | | 11/1995 | Winston | D18/15 |
| D. 364,417 | | 11/1995 | Winston | D18/15 |
| D. 369,384 | | 4/1996 | Yasoshima | D19/36 |
| 771,435 | | 10/1904 | Metcalf . | |
| 1,073,036 | | 9/1913 | Fuchs . | |
| 1,255,925 | | 2/1918 | Peters . | |
| 1,478,388 | | 12/1923 | Gray . | |
| 1,512,085 | | 10/1924 | Clary . | |
| 2,173,451 | | 9/1939 | Lorber | 120/103 |
| 2,237,969 | | 4/1941 | Olsen | 15/143 |
| 2,584,908 | * | 2/1952 | Oblinger | 101/333 |
| 2,664,582 | | 1/1954 | Kammann | 15/143 |
| 2,819,668 | * | 1/1958 | McAneny | 101/125 |
| 2,873,464 | | 2/1959 | Rosenthal | 15/209 |
| 2,964,772 | | 12/1960 | Crawford | 15/244 |
| 2,970,539 | * | 2/1961 | Griffin | 101/368 |
| 3,096,713 | | 7/1963 | McLaughlin, Jr. | 101/379 |
| 3,142,855 | | 8/1964 | Gilchrist | 15/210 |
| 3,282,209 | | 11/1966 | Muskin | 101/373 |
| 3,432,446 | | 3/1969 | Coppeta | 260/2.5 |
| 3,478,682 | | 11/1969 | Funahashi | 101/327 |
| 3,797,390 | * | 3/1974 | Marozzi et al. | 101/333 |
| 3,855,925 | | 12/1974 | Funahashi | 101/333 |
| 3,948,173 | * | 4/1976 | Barasch | 101/333 |
| 4,145,967 | * | 3/1979 | Marozzi | 101/333 |
| 4,283,808 | | 8/1981 | Beebe | 15/145 |
| 4,625,640 | | 12/1986 | Bunger | 101/327 |
| 4,676,162 | | 6/1987 | Phipps, Sr. et al. | 101/405 |
| 4,752,147 | | 6/1988 | Persi | 401/126 |
| 4,817,526 | | 4/1989 | Winston | 101/329 |
| 4,986,175 | | 1/1991 | Boehringer et al. | 101/125 |
| 4,996,921 | | 3/1991 | Hong | 101/333 |
| 5,014,617 | * | 5/1991 | Lesyk | 101/333 |
| 5,049,432 | | 9/1991 | Ooms et al. | 428/159 |
| 5,228,387 | | 7/1993 | Siculan | 101/211 |
| 5,313,885 | | 5/1994 | Winston | 101/405 |

(List continued on next page.)

FOREIGN PATENT DOCUMENTS

| | | |
|---|---|---|
| 0 167 380 A2 | 1/1996 | (EP) . |
| 2 675 740 A1 | 10/1992 | (FR) . |
| 4940 | of 1896 | (GB) . |
| 2045687 | 11/1980 | (GB) . |
| 2 174 645 | 11/1986 | (GB) . |

OTHER PUBLICATIONS

Tsukineko, "Rubber Stamp/Ink Pad" 1996/97 Catalog pp. 1–8.
Stencil & Hobby Catalog (Japanese), 3 pages, 1999.
Tsukineko, "Fantastix ™" Product Brochure, May 1999.

*Primary Examiner*—John S. Hilten
*Assistant Examiner*—Leslie J. Grohusky
(74) *Attorney, Agent, or Firm*—Seed IP Law Group PLLC

(57) ABSTRACT

An ink vessel-containing stamp pad having an ink pad saturated with ink, the main body having ink storage area which stores an ink vessel, a cap which covers said ink pad and is freely placeable on and removable from said main body, said ink vessel stored in said ink storage area and a bottom plug covering the exterior of said ink storage area which stores said ink vessel.

22 Claims, 10 Drawing Sheets

U.S. PATENT DOCUMENTS

| | | | | |
|---|---|---|---|---|
| 5,431,098 | * | 7/1995 | Winston | 101/211 |
| 5,435,245 | | 7/1995 | Salisbury et al. | 101/328 |
| 5,462,595 | * | 10/1995 | Im | 101/333 |
| 5,505,130 | * | 4/1996 | Winston | 101/333 |
| 5,577,444 | | 11/1996 | Toyama | 101/379 |
| 5,671,497 | | 9/1997 | Abdo | 15/144.1 |
| 5,865,305 | | 2/1999 | Yasoshima | 206/1.7 |
| 5,870,796 | | 2/1999 | Yasoshima | 15/244.1 |
| 6,098,237 | | 8/2000 | Yasoshima | 15/227 |

* cited by examiner

INK VESSEL-CONTAINING STAMP PAD

CROSS-REFERENCE TO RELATED APPLICATION

This application claims priority to Japanese Patent Application No. 10-310502, filed Oct. 30, 1998.

TECHNICAL FIELD

This invention concerns a stamp pad which contains an ink vessel.

BACKGROUND OF THE INVENTION

Traditionally, stamp pads are widely used for rubber stamp affixation. Stamp pads are of various sizes and shapes to accommodate various sizes of rubber stamps. One example is shown below.

FIG. 7 is a schematic cross-sectional view of a traditional stamp pad. As shown in the figure, the traditional stamp pad consists of a pad base 21, an ink pad 22, which is made of such ink-absorbing materials as sponge, felt, etc., soaked with pigment ink or dye ink, and a cap 23 which covers said ink pad 22. The circumference of said pad base 21 has notches made with which the tip of the circumference of said cap 23 engages so that the lid can be opened and closed freely. FIG. 8 is a schematic oblique view of a stamp pad with its lid removed, showing pad base 21 and ink pad 22.

More recently, stamp pads have become colorful and stamp pads with various colors of stamp ink are available in the market.

In using a stamp pad for rubber stamp affixation, rubber stamp 24 is lightly pressed on ink pad 22 of stamp pad, as shown in FIG. 9, to obtain ink on the rubber stamp for affixation thereof on the proper place for stamp affixation on paper, cloth, leather, plastic, etc.

Repeated use of a stamp pad by removing and replacing cap 23 from and back on pad base 21 as described above may cause the soiling with ink of the interior of cap 23 as a result of its contact with ink pad 22.

In addition, repeated rubber stamp affixation as described above will gradually decrease and use up the ink absorbed in stamp pad, necessitating the replenishment of ink.

Traditionally, ink replenishment was accomplished either by purchasing an ink vessel which contains the ink of the same color or purchasing in advance and storing an ink vessel which contains replenishment ink and using such ink in such ink vessel to soak the stamp pad.

The purchasing of ink has caused inconvenience at times, however, because the ink of the same color could not be found or only a small amount of additional ink was needed because of less frequent use of the ink or because ink was needed immediately.

The inconvenience on the part of stamp pad manufacturers included the costliness of stocking and making available many different kinds of replenishment ink and the difficulty in keeping the inventory of less frequently used types of ink for a long period of time, resulting in the out-of-stock status for certain types of ink.

Furthermore, stamp pads were often disposed of once ink ran out, resulting in a wasteful, uneconomical practice, which also contributed to the increase of garbage to be processed.

SUMMARY OF THE INVENTION

This invention is made to improve such shortcomings of the prior art as described above and is intended to provide a stamp pad which makes it easy to replenish ink when it runs out by storing a replenishment ink vessel in the stamp pad in such manner as to make it easy to remove the ink vessel.

This invention is also intended to provide a stamp pad which prevents the soiling with ink of the interior of a cap as the stamp pad is used repeatedly.

DETAILED DESCRIPTION OF THE INVENTION

Figure 1:
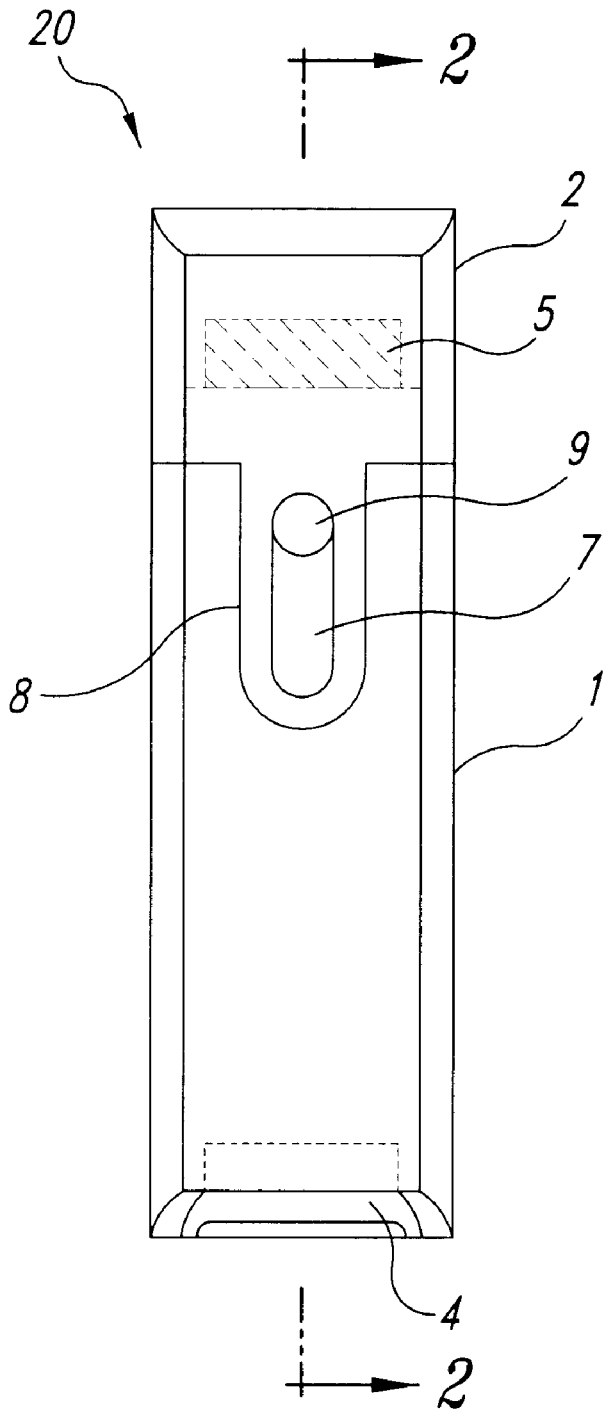
FIG. 1 is a schematic front view showing an example of the stamp pad of the present invention.

An embodiment of this invention concerns an ink vessel-containing stamp pad characteristic of having an ink pad saturated with ink, the main body which has an ink storage area for storing an ink vessel, a cap which covers said ink pad and is designed for free placement on and removal from the main body, an ink vessel stored in said ink storage area and a bottom plug which covers the exterior of the ink storage area which stores said ink vessel and is designed for free placement on and removal from the main body.

Desirably, the aforesaid cap and main body can be independent of each other so that the cap is separated from the main body when removed.

Desirably, the aforesaid cap can have fitting notches which slidably fit the protrusions made on the main body, and said cap can be placed on and removed from the main body while said fitting notches and the protrusions are connected with each other.

An embodiment of this invention also concerns an ink vessel-containing stamp pad characteristic of having an ink pad saturated with ink, the main body which has an ink storage area for storing an ink vessel, a cap which covers said ink pad and is designed for free placement on and removal from the main body, an ink vessel stored in said ink storage area and a bottom plug which connects to said ink vessel and covers the exterior of the ink storage area which stores the ink vessel and is designed for free placement on and removal from the main body, and is characteristic of having the ink vessel together with the bottom plug freely placeable on and removable from the main body.

Desirably, the aforesaid bottom plug can serve as the lid for said ink vessel and is connected to said ink vessel.

Desirably, the aforesaid bottom plug and ink vessel can be tightly connected to each other at the interior of such bottom plug and the opening of such ink vessel.

Desirably, the aforesaid bottom plug and ink vessel can be connected at the interior of said bottom plug and the opening of said ink vessel by way of threading.

Desirably, the aforesaid cap and main body can be independent of and separable from each other so that the cap is freely placed on and removed from the main body.

Desirably, the aforesaid cap can have fitting notches which slidably fit the protrusions made on the main body and is placed on and removed from the body while said fitting notches and said protrusions are kept connected.

An embodiment of the ink vessel-containing stamp pad of the present invention is characteristic of containing an ink vessel inside which contains replenishment ink. More specifically, it is characteristic of having an ink pad saturated with ink, the main body having an ink storage area which stores an ink vessel, a cap which covers said ink pad and is freely placeable on and removable from the main body, an ink vessel stored in said ink storage area and a bottom plug which covers the exterior of said ink storage area which stores said ink vessel and is freely placeable on and removable from the main body.

The cap of the ink vessel-containing stamp pad of the present invention is designed to cover an ink pad saturated with ink. The manner of installing said cap may be one of the following methods: (1) said cap and the main body are independent of each other, and after said cap is installed on the main body, the main body and the cap are separated when the cap is removed; or (2) fitting notches are made on said cap and the fitting notches slidably fit the protrusions made on the main body, and the cap and the main body are kept connected at such fitting notches and the protrusions and are not separated when the cap is placed on and removed from the main body, and when the cap is removed from the main body after it is placed on the main body, the main body and the cap are not separated.

The ink vessel filled with replenishment ink of the ink vessel-containing stamp pad of the present invention is stored in the ink storage area in the main body. Said ink vessel and the bottom plug covering the exterior of such ink storage area of the main body may be parts separate and independent of each other, or the opening of the ink vessel and the bottom plug may be fastened with each other by way of threading or by way of close engagement.

As described above, the ink vessel-containing stamp pad of the present invention enables immediate replenishment of ink while in use when the ink in the ink pad runs out because the stamp pad contains an ink vessel inside which contains replenishment ink, hence eliminating the necessity of purchasing and storing a separate ink vessel which contains the ink of the same color. Also eliminated is the disposal of a stamp pad after one time use because the replenishment ink of the same color cannot be found, thus achieving better economy and contributing to the decrease in garbage to be processes.

The difficulty and inconvenience in the inventory management associated with the manufacturing and selling of stamp pads, i.e., it is costly and burdensome to prepare and stock each and every different kind of ink and particularly to stock for a long period of time certain kinds of ink which are used less frequently, resulting at times in the out-of-stock status of certain colors, will be eliminated by the stamp pad of the present invention.

The repeated use of a stamp pad with a cap which separates from the main body when removed may cause the interior of the cap to be soiled with ink as a result of the contact with the ink pad. The use of the stamp pad of the present invention which has a cap equipped with fitting notches which slidably fit the protrusions made on the main body and which does not separate from the main body as the cap and the main body maintain the engagement between the fitting notches and the protrusions makes it easier to place and remove the cap because the orbit of the cap movement is restricted by the fitting notches and the protrusions, and prevents the soiling with ink of the interior of the cap because the cap does not contact the ink pad when placed on and removed from the main body.

Examples of the embodiment of the present invention are explained in concrete terms based on figures given below.

EXAMPLE 1

Figure 2:
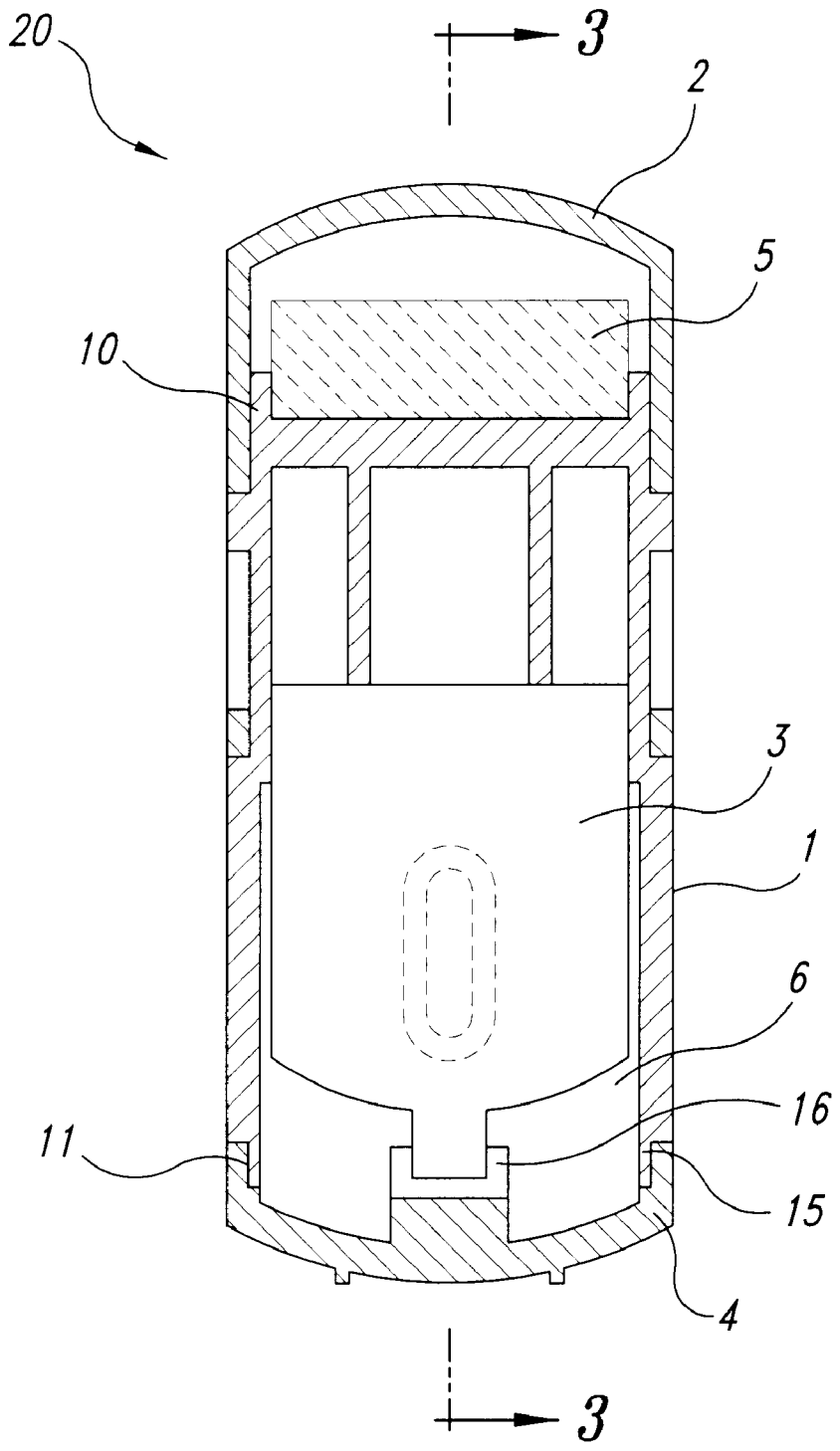
FIG. 2 is a 2—2 cross-sectional view of FIG. 1.
Figure 3:
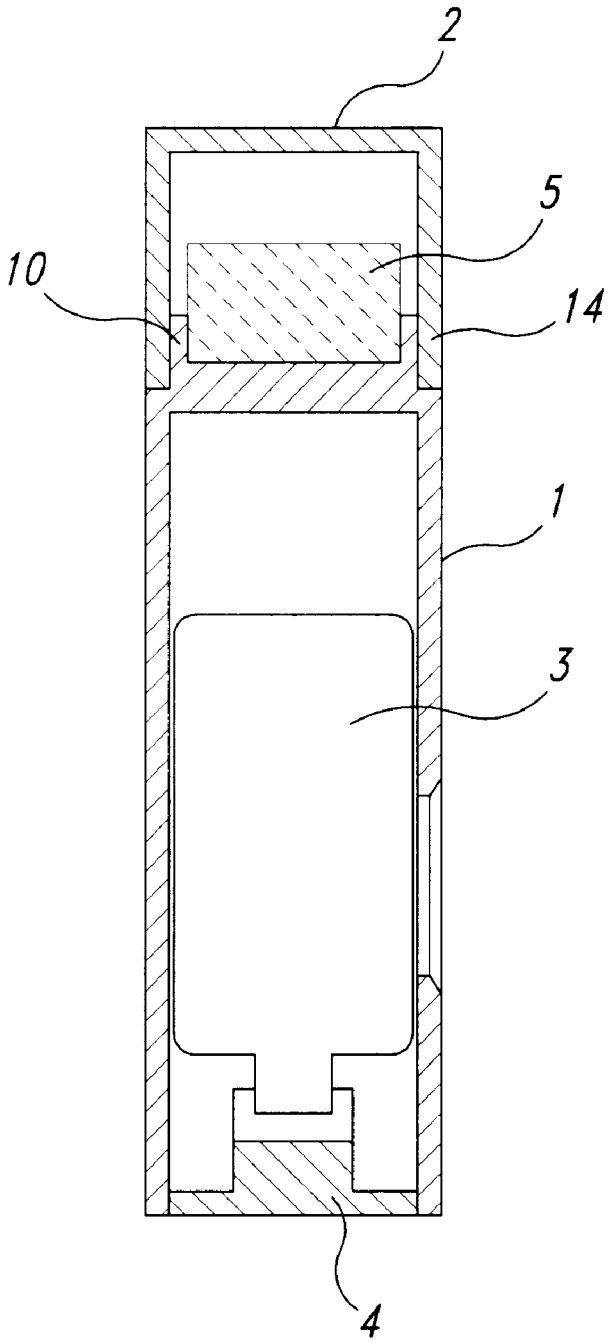
FIG. 3 is a 3—3 cross-sectional view of FIG. 2.

FIG. 1 is a schematic front view of an embodiment of the stamp pad of the present invention. FIG. 2 shows an A to A cross-sectional view. FIG. 3 shows a B to B cross-sectional view.

As shown in the figures, the ink vessel-containing stamp pad of the present invention 20 has main body 1, cap 2, ink vessel 3 and bottom plug 4. Main body 1 has ink pad 5 saturated with ink and ink storage area 6 to store ink vessel 3, and cap 2 which covers said ink pad 5 and can be freely placed on and removed from main body 1. Stored in the ink storage area 6 is ink vessel 3 which has vessel lid 16. Covering the exterior of said ink storage area 6 which stores said ink vessel 3 is bottom plug 4 which can be freely placed on and removed from main body 1.

Cap 2 and main body 1 are formed so as to cover ink pad 5 which is placed on main body 1. The tip 14 of the circumference of cap 2 is formed so as to engage with the recessed area 10 made on the circumference of main body 1 for capping purposes, and can be freely engaged and disengaged.

Figure 4:
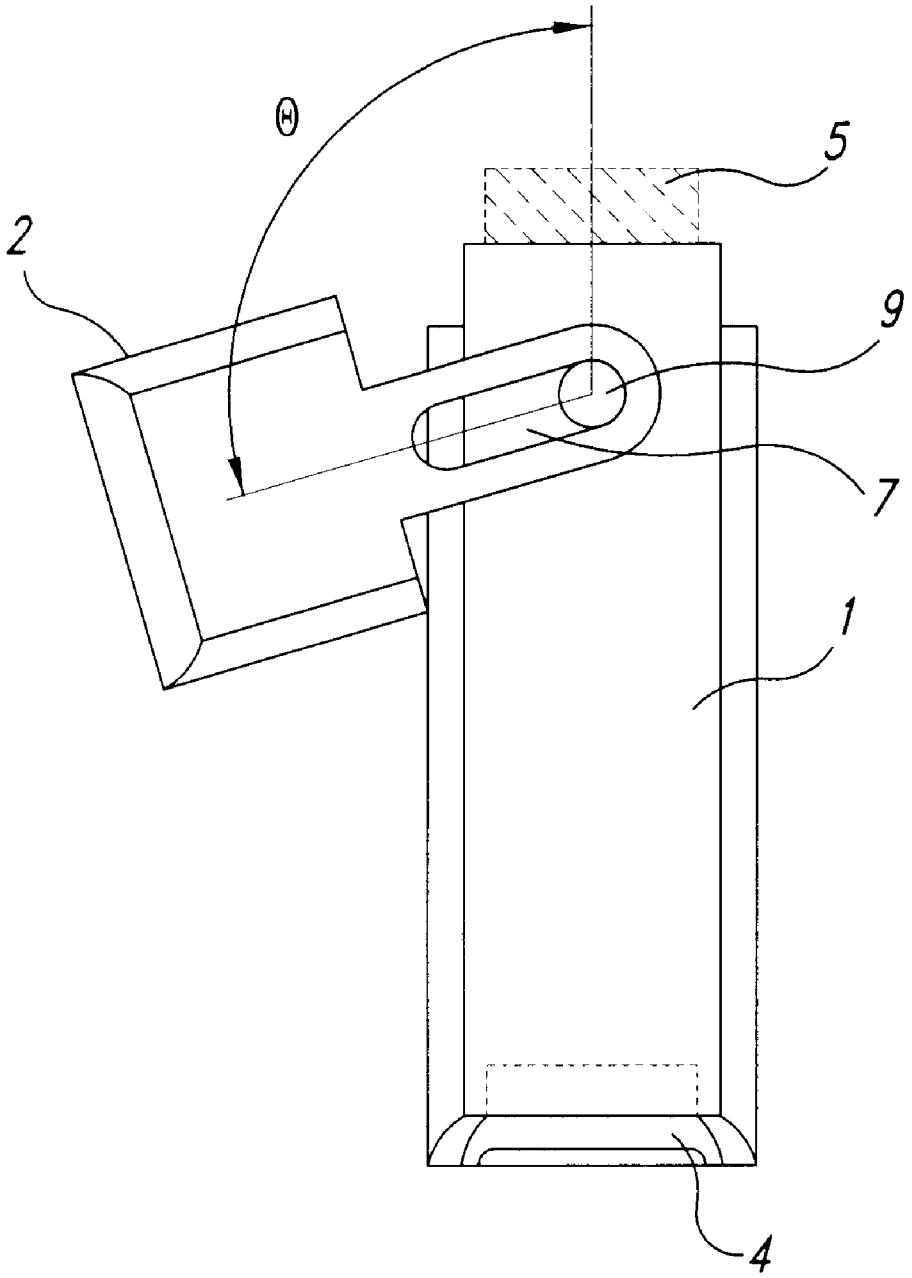
FIG. 4 is a schematic drawing showing the design in which cap and main body are connected.

FIGS. 1 through 3 show the design where cap 2 and main body 1 are fitted to each other; cap 2 has 2 flaps 8 and each of said 2 flaps has fitting notch 7; said fitting notch 7 freely slidably fits protrusion 9 made on main body; cap 2 and main body 1 maintain the fitted status of fitting notch 7 and protrusion 9 and do not separate from each other. When cap 2 is placed on and removed from main body 1, the orbit of the movement of cap 2 is restricted by fitting notch 7 and protrusion 9, making cap placement and removal easy, and keeping the cap from contacting the ink pad at placement and removal, preventing the soiling with ink of the interior of the cap. As is shown in FIG. 4, the angle θ between cap 2 and main body 1 when cap 2 is fully open is at least 90 degrees and, desirably, 108 degrees.

There is no particular restriction on the material to be used for the main body or the cap, but plastic, either colored or transparent, is desirable.

Main body 1 has an ink storage area 6; ink storage area 6 stores ink vessel 3. There is no particular restriction on the size of ink vessel 3, but desirably, it should have the capacity to store the quantity of ink which enables at least 3 to 6 times of replenishment.

Covering the exterior of ink storage area 6 which stores ink vessel 3 is bottom plug 4 on the main body. Bottom plug 4 and main body 1 are formed so as to be freely engaged with and disengaged from each other by way of the engagement of the recessed area 11 made in the circumference of main body 1 with the tip 15 of bottom plug 4.

As described above, because the ink vessel-containing stamp pad of the present invention contains an ink vessel 3 which contains replenishment ink, ink vessel 3 can be removed from main body 1 by opening bottom plug 4 to replenish ink of the same color when ink in ink pad runs out while in use.

EXAMPLE 2

Figure 5:
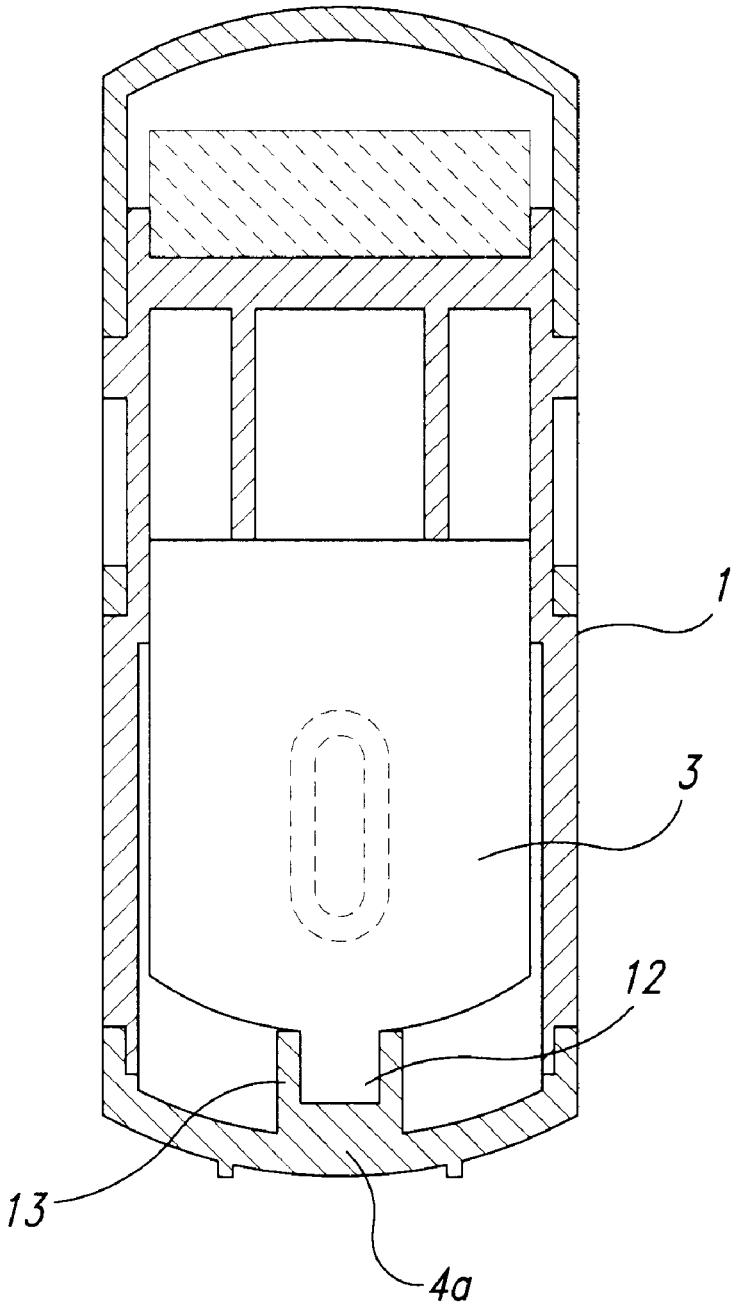
FIG. 5 is a cross-sectional view of another example of the stamp pad of the present invention.

FIG. 5 is a cross-sectional view showing another example of the stamp pad of the present invention.

The stamp pad shown in the figure has the opening 12 of ink vessel 3 and bottom plug 4*a* connected with each other by way of threading or by way of close engagement with each other with bottom plug 4*a* serving as the lid 13 for ink vessel 3. The remaining has the configuration similar to that of Embodiment Example 1.

With this embodiment example, ink vessel 3 can be removed from main body 1 together with bottom plug 4.

EXAMPLE 3

Figure 6:
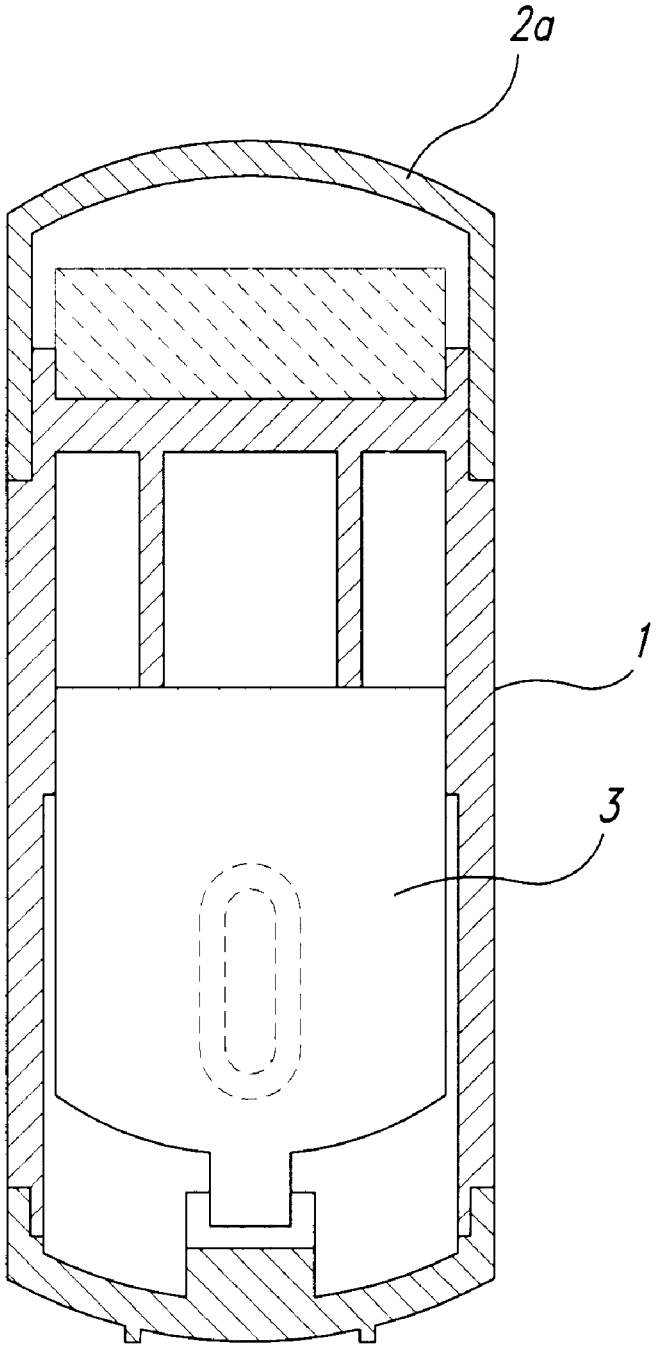
FIG. 6 is a cross-sectional view of another example of the stamp pad of the present invention.
Figure 7:
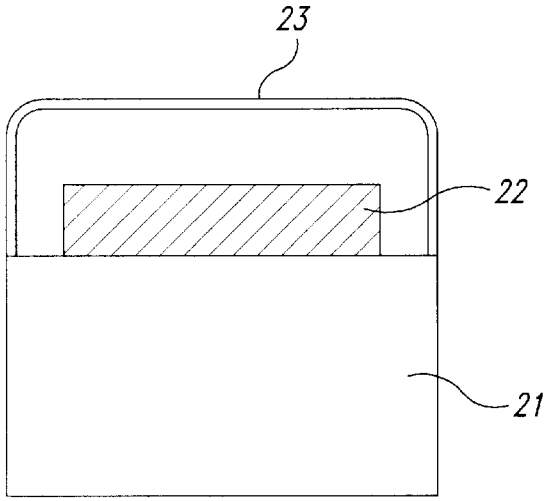
Fig. 7 (Prior Art)
FIG. 7 is a schematic drawing showing an example of traditional stamp pads.
Figure 8:
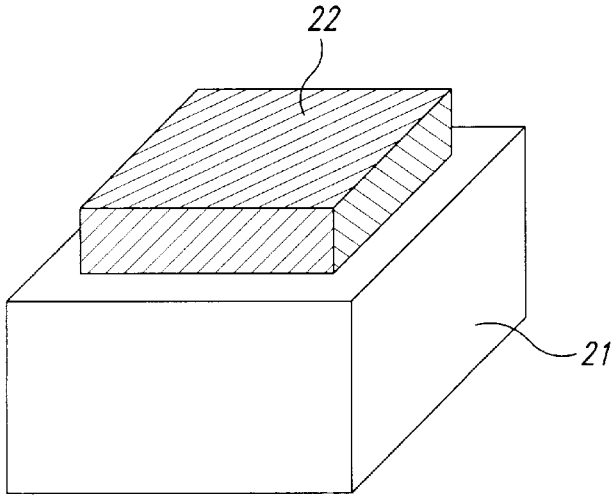
Fig. 8 (Prior Art)
FIG. 8 is a schematic oblique view of a traditional stamp pad.
Figure 9:
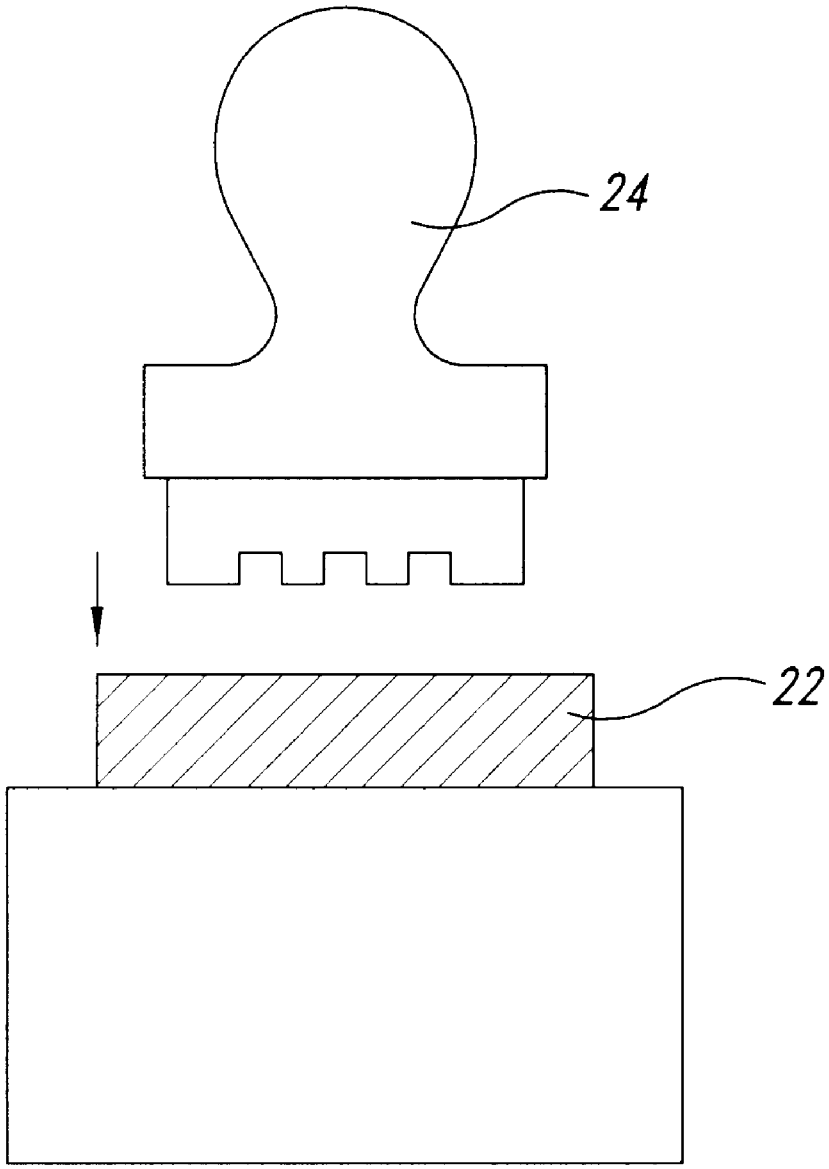
Fig. 9 (Prior Art)
FIG. 9 is a descriptive drawing showing the method of using a traditional stamp pad and a rubber stamp.

FIG. 6 is a cross-sectional view showing another example of the stamp pad of the present invention.

The stamp pad shown in the figure has cap 2*a* and main body 1 independent of each other and separable and removable from each other. The remaining has the configuration similar to that of Embodiment Example 1.

EXAMPLE 4

Figure 10:
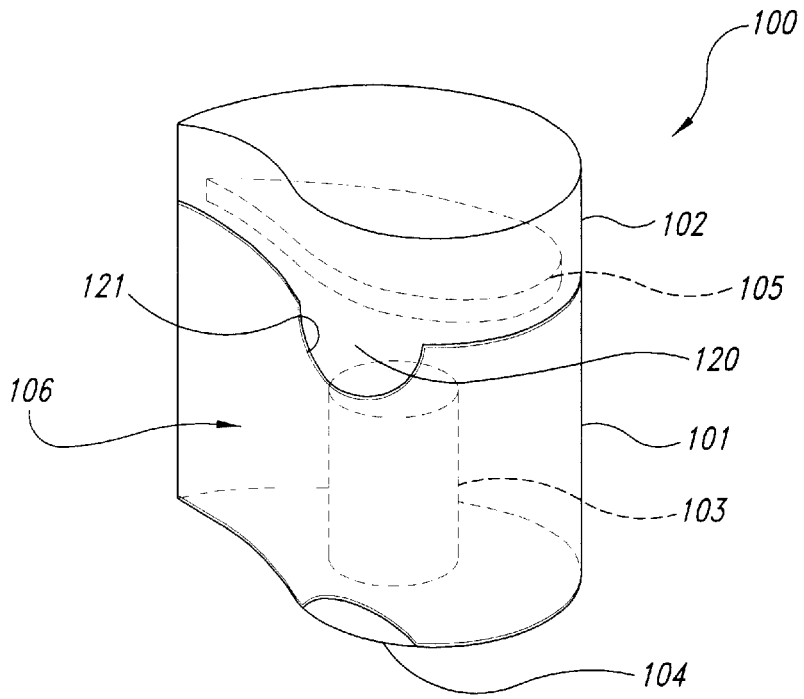
FIG. 10 is a side isometric view of a stamp pad in accordance with another embodiment of the invention.

FIG. 10 is a side isometric view of a stamp pad 100 in accordance with another embodiment of the invention. The stamp pad 100 has a body 101 with a cavity 106 in which an ink vessel 103 is removably disposed. A bottom plug 104 covers the cavity 106 and can also seal the vessel 103, in a manner generally similar to the bottom plug 4*a* discussed above with reference to FIG. 5.

The stamp pad 100 can also include an ink pad 105 and a cap 102 that is removably coupled to the body 101 to cover the stamp pad 105. The cap 102 can be completely separable from the body 101, as shown in FIG. 10, or alternatively, the cap 102 can be movably secured to the body 101 with a slotted guide, as was discussed above with reference to FIGS. 1–3. In either case, the cap 102 can include rounded portions 120 that are removably received by corresponding rounded recesses 121 in the body 101.

As shown in FIG. 10, the plan form of the ink pad 105 (and the cross-sectional shape of the body 101 and the cap 102 when intersected by a plane generally parallel with the ink pad 105) can have a "tear-drop" type shape with one end generally pointed and the other end generally rounded. The sides between the opposing ends can also be rounded, with one side having a generally convex portion and the other side having an "S" shape with both a convex and a concave portion.

Figure 11:
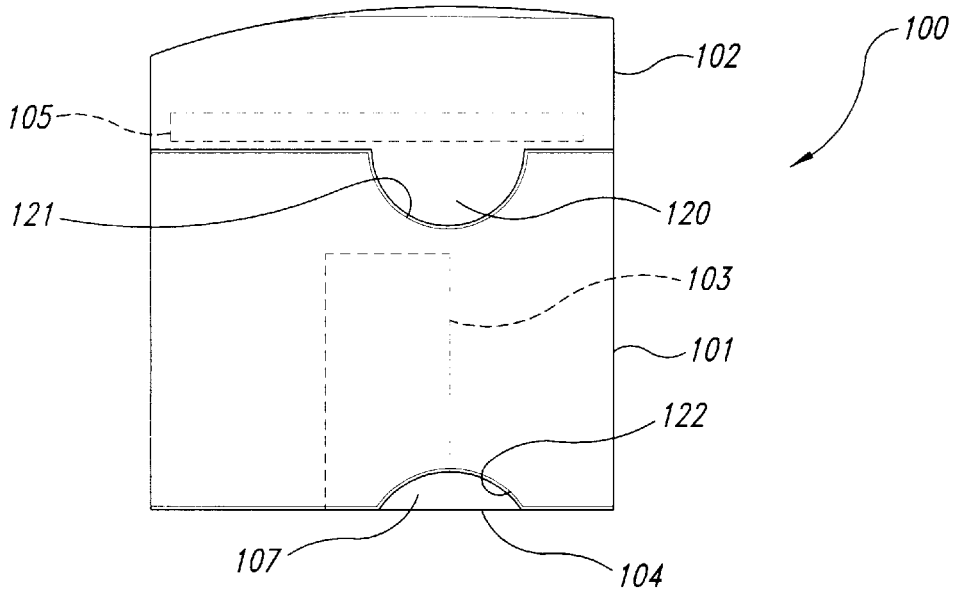
FIG. 11 is a side elevation view of the stamp pad shown in FIG. 10.

FIG. 11 is a side elevation view of the stamp pad 100 shown in FIG. 10. As shown in FIG. 11, the cap 102 has a crowned shape such that in profile, it rises slightly between opposing ends of the cap 102. As is also shown in FIG. 11, the plug 104 can have rounded portions 107 that are removably received by corresponding rounded recesses 122 in the body 101.

Figure 12:
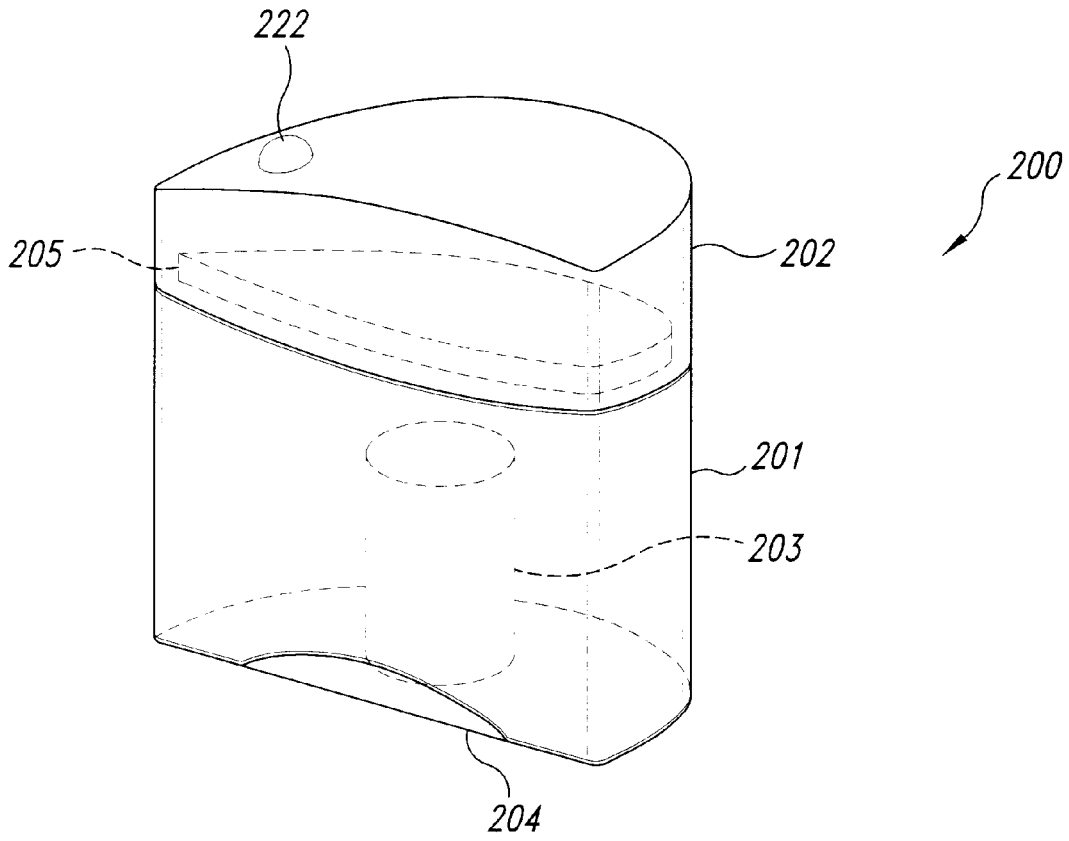
FIG. 12 is a side isometric view of a stamp pad in accordance with yet another embodiment of the invention.

FIG. 12 is a side isometric view of a stamp pad 200 in accordance with yet another embodiment of the invention. As shown in FIG. 12, the stamp pad 200 can include a body 201, a cap 202, a base plug 204, and an ink vessel 203 arranged in a manner generally similar to that discussed above with reference to FIGS. 1–6 and 10–11. The stamp pad 200 can further include an ink pad 205 covered by the cap 202. The ink pad 205, the cap 202 and the body 201 each have a modified tear-drop shape with one side being generally flat and the other side being generally convex. In a further aspect of this embodiment, the cap 202 can include a small protuberance 222 toward one end thereof. As was discussed previously, the cap can be transparent, translucent, or colored. In one aspect of this embodiment, the cap 202 can include a logo or other design and/or writing.

As described above, the present invention, which stores inside a stamp pad an ink vessel which contains replenishment ink in such a manner that is easy to retrieve it, enables easy ink replenishment when ink runs out, hence providing a economical stamp pad.

The present invention also provides a stamp pad which prevents its cap from contacting the ink pad, resulting in the soiling with ink of the interior of the cap as the stamp pad is used repeatedly.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A stamp pad assembly, comprising:

a body having a first end, a second end and an interior ink storage area, the first end of the body having an ink pad and the second end of the body having a first opening to the interior ink storage area;

an ink vessel removably disposed in the ink storage area, the ink vessel having a second opening therein configured to allow ink to be moved into and out of the ink vessel, the second opening in the ink vessel being positioned proximate the second end of the body;

a first cap coupled to the first end of the body and movable between a first position with the first cap covering the ink pad and a second position with the first cap offset from the ink pad to expose the ink pad; and a second cap removably attached to the second end of the body to cover the first opening in the body and retain the ink vessel within the body, the second cap also being removably, sealably attached to the second opening in the ink vessel to keep the ink in the ink vessel.

2. The stamp pad assembly of claim 1 wherein the first cap is completely separate from the body when the first cap is in the second position.

3. The stamp pad of claim 1 wherein the body has a first edge and a second edge opposite the first edge, further wherein the first cap has a first edge aligned with the first edge of the body and a second edge aligned with the second edge of the body, the first cap having an upper surface extending in a convex upward direction between the first and second edges of the first cap.

4. The stamp pad of claim 1 wherein the first cap includes a partially spherical projection extending away from the ink pad.

5. The stamp pad of claim 1 wherein the first cap is at least partially transparent.

6. The stamp pad of claim 1 wherein the first cap is at least partially translucent.

7. The stamp pad of claim 1 wherein the body has an upwardly facing edge with a recessed region and the first cap has a downwardly extending portion removably received in the recessed region.

8. The stamp pad of claim 1 wherein the body has a downwardly facing edge with a recessed region and the second cap has an upwardly extending portion removably received in the recessed region.

9. The stamp pad of claim 1 wherein the first end of the body has a generally pointed shape when intersected by a plane generally parallel to the ink pad, and the second end of the body has a generally rounded shape when intersected by a plane generally parallel to the ink pad.

10. The stamp pad of claim 1 wherein the body has a first side and a second side opposite the first side, the first side having a generally concave region, the second side having a generally convex region.

11. The stamp pad of claim 1 wherein the body has a first side and a second side opposite the first side, the first side having a generally flat region, the second side having a generally convex region.

12. A method for making a stamp pad assembly, comprising:

providing a body with a first portion, a second portion and a cavity therein, the first portion of the body having a first opening to the cavity;

removably disposing an ink vessel having a second opening within the cavity with the second opening in the ink vessel positioned proximate the first opening in the body;

removably coupling a cap to the first portion of the body, the cap being configured to cover the first opening and sealably cover the second opening;

attaching an ink pad to the second portion of the body; and removably covering the ink pad.

13. The method of claim 12 wherein removably covering the ink pad includes removably covering the stamp pad with an at least partially translucent cover.

14. The method of claim 12 wherein removably covering the ink pad includes removably covering the ink pad with an at least partially transparent cover.

15. The method of claim 12 wherein providing a body includes providing a stamp pad body with a first side and a second side opposite the first side, the first side having a generally concave region, the second side having a generally convex region.

16. The method of claim 12, further comprising impregnating the ink pad with ink.

17. The method of claim 12 wherein removably covering the ink pad includes removably covering the second portion of the body.

18. The method of claim 12 wherein removably covering the ink pad includes slidably engaging a stamp pad cover with a protrusion extending from the body.

19. The method of claim 12, further comprising filling the ink vessel with ink.

20. A stamp pad assembly comprising:

a body having an ink pad and an opening to an interior ink storage area, the body having at least one protrusion extending therefrom;

an ink vessel removably disposed in the ink storage area;

a cap having a guide with a slot slidably engaged with the protrusion, the guide being slidable relative to the protrusion as the cap moves between a first position with the cap covering the ink pad and a second position with the cap offset from the ink pad to expose the ink pad; and a plug member removably attached to the body to cover the opening in the body.

21. A stamp pad assembly for directly, manually applying ink to a rubber stamp or substrate, the stamp pad comprising:

a unitary body configured to be held in a user's hand, the body having first and second ends and an interior storage area located within the body, the first end having an opening to the interior storage area, the interior storage area being sized and shaped to receive an ink vessel, and a physical barrier between the interior storage area and the second end to prevent ink from passing therebetween;

an ink pad projecting from the second end of the body for applying ink to a surface, the ink pad configured to be impregnated with ink;

a cap removably coupled to the second end of the body to selectively expose and cover the ink pad; and a plug member removably engaged with the opening in the first end of the body to selectively cover the opening and provide access to interior storage area.

22. The stamp pad assembly of claim 21 wherein the opening in the first end of the body is a first opening, and further comprising:

an ink vessel removably disposed in the ink storage area, the ink vessel having a second opening therein configured to allow ink to be moved into and out of the ink vessel, the second opening in the ink vessel being positioned proximate the first end of the body; and wherein the plug member is configured to engage both the first opening in the body and the second opening in the ink vessel.

* * * * *